United States Patent [19]

Budzich

[11] Patent Number: 4,799,420

[45] Date of Patent: Jan. 24, 1989

[54] LOAD RESPONSIVE CONTROL SYSTEM ADAPTED TO USE OF NEGATIVE LOAD PRESSURE IN OPERATION OF SYSTEM CONTROLS

[75] Inventor: Tadeusz Budzich, Moreland Hills, Ohio

[73] Assignee: Caterpillar Inc., Peoria, Ill.

[21] Appl. No.: 89,878

[22] Filed: Aug. 27, 1987

[51] Int. Cl.[4] ..... F15B 13/08

[52] U.S. Cl. ..... 91/529; 91/446; 91/461; 137/596.1; 137/596.13; 137/596.14; 137/625.6

[58] Field of Search ..... 91/446, 461, 529; 137/596.1, 596.13, 596.14, 625.6

[56] References Cited

U.S. PATENT DOCUMENTS

| | | | |
|---|---|---|---|
| 4,222,409 | 9/1980 | Budzich | 137/596.13 |
| 4,488,474 | 12/1984 | Budzich | 91/446 |
| 4,610,194 | 9/1986 | Budzich | 91/446 |
| 4,679,492 | 7/1987 | Budzich | 91/420 |
| 4,688,470 | 8/1987 | Budzich | 91/420 |
| 4,694,731 | 9/1987 | Budzich | 91/421 |

*Primary Examiner*—Gerald A. Michalsky
*Attorney, Agent, or Firm*—J. W. Burrows

[57] ABSTRACT

A load responsive control system using on a selective basis the energy derived from a negative type load for operation of system controllers, which may be of various types, including electro-hydraulic multi-stage controls, for use in positioning of the main control spools and in control of other system components.

15 Claims, 2 Drawing Sheets

W
8
11
80
14
17
79
14
Ps
89
32
34
27
X1
X
81
82
26
23
31
29
37
28
30
33
47
39
38
36
35
85
86
83
84
A
104
B
87
60
45
42
13
88
106
22
92
105
C2
100
101
10
90
A
98
93
94
103
97
96
102
99
95
B
C1
21
40
67
68
25
19
91
24
64
65
66
53
57
75
76
73
78
63
62
71
54
56
59
58
55
70
20
77
14
107
74
61
52
69
43
50
46
49
48
51
44
41
109
72
18
108
16
12
106a
15
14

LOAD RESPONSIVE CONTROL SYSTEM ADAPTED TO USE OF NEGATIVE LOAD PRESSURE IN OPERATION OF SYSTEM CONTROLS

TECHNICAL FIELD

This invention relates generally to a load responsive control system and more particularly to a control system that selectively derives energy from a negative type load for the operation of the system controllers.

BACKGROUND OF THE INVENTION

In prior art the control components, like for example direction and flow control valves, used in control of fluid motors subjected to loads, respond to manual, electrical or other remote control signals, at a comparatively low energy level, by proportionally amplifying such signals for transmittal to the control elements of the system, though the use of fluid power energy. Such fluid power energy can be derived from a separate source of fluid power, or from the main system pump, which powers the hydraulic system.

The use of a separate source of fluid power to provide the energy for operation of the system controls is very desirable, since it is completely independent of the duty cycle of the primary hydraulic power system. However, such an independent source of pressure suffers from several disadvantages, like for example inefficient use of power, especially with the hydraulic system in standby condition. Also in mobile type systems, using internal combustion engines as the prime mover, such a separate source of fluid power needs a separate power takeoff, which is not only expensive, but also utilizes a lot of space, which in such applications is at a premium.

Many industrial and mobile type systems use fluid flow at system pressure derived from the main system pump. In such systems, especially during the control of negative loads, the system pressure, which is dictated by the magnitude of the load, may drop to a pressure level below that required by the system controls. This disadvantage can be overcome by preventing the discharge pressure of the system pump dropping below a certain minimum pressure level, as dictated by the characteristics of the system controls. Some of those controls, especially of an electro-hydraulic servo type, well known in the art, require a relatively high pressure level, which results in the loss of large amounts of fluid power in the main fluid power system, especially when controlling small positive loads, or negative type loads.

Another disadvantage of this approach results from the trend, well known to those skilled in the art, of using in mobile systems maximum operating system pressures, well in excess of say 5000 PSI. In such systems not only pressure reducing type devices must be interposed between the main system pump and system controls, but the use of say 5000 PSI pressure, at substantially high flow levels, to supply fluid power to system controls, at say 1000 PSI pressure level, results in large amounts of fluid power being converted to heat by throttling, loss in system efficiency and loss of power derived from tee system pump to perform the work at the tool.

SUMMARY OF THE INVENTION

In one aspect of the present invention a load responsive control system is provided comprising at least one actuator operable to control a positive and a negative load, exhaust means and a source of pressure fluid, first valve means operable to selectively interconnect said actuator with said exhaust means and said source of pressure fluid and to control fluid flow to and from said actuator, control means operable to control fluid flow to and from said actuator, and second energizing means operable to use energy from said negative load while said actuator controls a negative load. The control means also has first energizing means operable to use energy from said source of pressure fluid while said actuator controls a positive load.

It is therefore a principal object of this invention to use the energy of the negative load being controlled by the hydraulic system to either fully supply the energy required by the system controls, or at least to supplement and therefore decrease the amount of energy extracted from the main power circuit, during control of such negative loads.

It is another object of this invention to use the flow at negative load pressure, to supply the fluid power demand of the system controls, during control of negative load, in such a way that the flow extracted at negative load pressure does not affect in any way whatsoever the accuracy and response of the controls used in positioning, or in control of the velocity of the negative load.

It is still another object of this invention, in a system simultaneously controlling multiple positive loads and at least one negative load, to use the flow at negative load pressure to supply fluid power demand of the system controls, for control of both positive and negative loads.

It is still another object of this invention to increase the level of the negative load pressure by the energy derived from the system pump to a certain minimum predetermined negative load pressure level, required for operation of the system controls.

Briefly the foregoing and other objects of this invention are accomplished by using the energy of the negative load, which is supported by the negative load pressure developed in the fluid motor, and which must be converted into heat by throttling, during control of such a load, to perform useful work not only in providing fluid power to the system controls used in control of fluid motors subjected to negative and positive loads, but also for the use of other system controls and to perform other useful work.

Additional objects of this invention will become apparent when referring to the preferred embodiments of this invention as shown in the accompanying drawings and described in the following detailed description.

DESCRIPTION OF THE PREFERRED EMBODIMENTS

Figure 1:
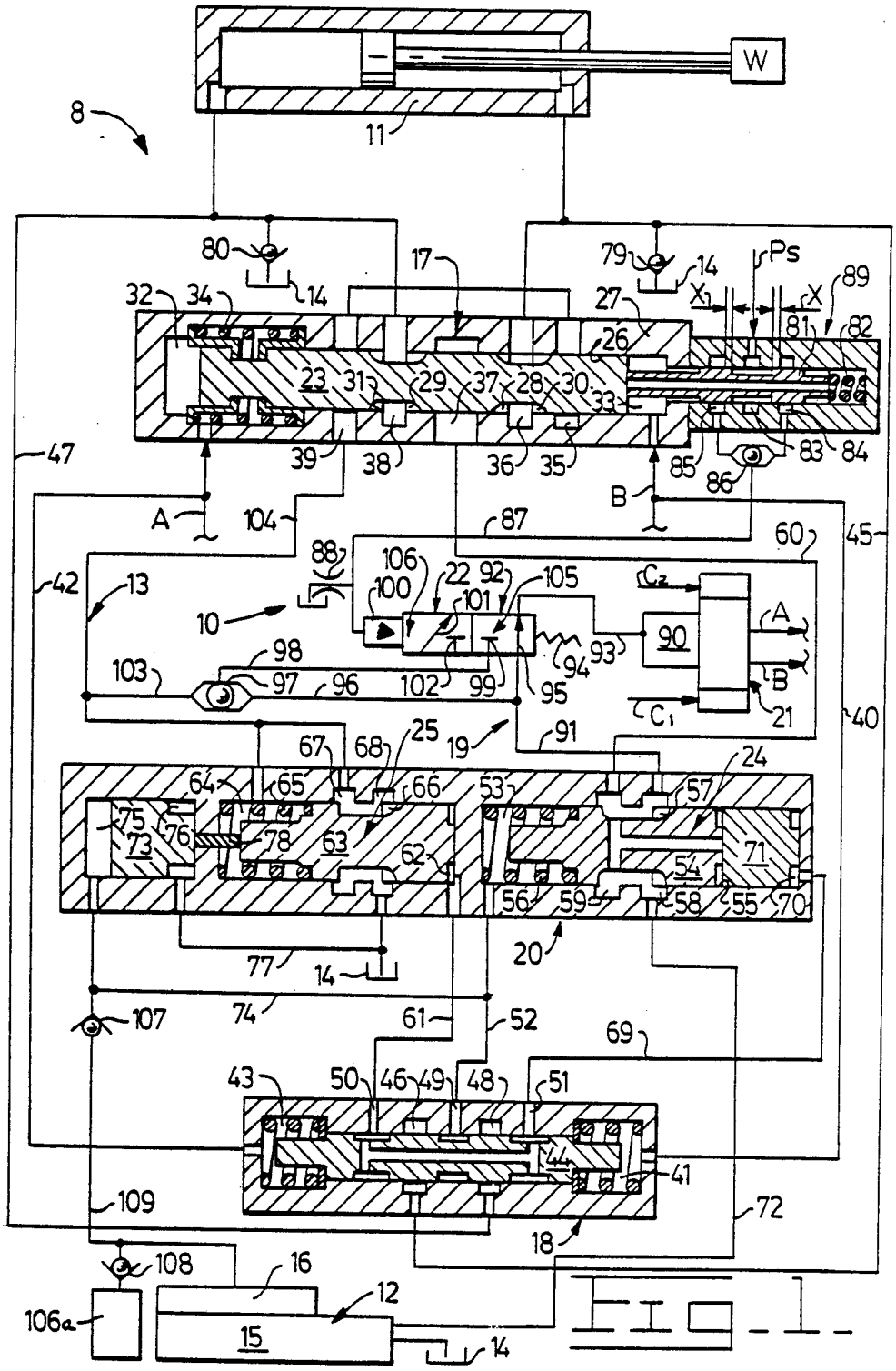
FIG. 1 shows a sectional view of a direction control valve together with a sectional view of the system throttling controls, including positive and negative load compensators, a sectional view of an external logic module and system actuator, with system pump, system reservoir and spool positioning controls shown diagrammatically, all connected into a working circuit by schematically shown fluid conducting lines.

Referring now to the drawings and for the present to FIG. 1, a load responsive control system 8 is provided and includes a load responsive valve assembly, generally designated as 10, interposed between an actuator 11 operably connected to a load W and a fluid conducting system including a source of pressure fluid, generally designated as 12, and exhaust means 13 which includes a reservoir 14. The source of pressure fluid 12 includes a pump 15, provided with an output flow control 16, which may be of a bypass type, or of a variable displacement type, well known in the art, and which may respond, in a well known manner, to the maximum load signal pressure of the load responsive fluid power and control system of FIG. 1.

The load responsive valve assembly 10 comprises first valve means, generally designated as 17, shown in FIG. 1 in the form of a spool type direction and flow control valve, well known in the art, load pressure identifying means, generally designated as 18, and control means, generally designated as 19, which may include load pressure compensating means, generally designated as 20, flow control means, generally designated as 21, and interconnecting means, generally designated as 22. First valve means 17 is provided with spool means, such as a direction control spool 23, while load pressure compensating means 20 is provided with positive load compensating means, generally designated as 24, and negative load compensating means, generally designated as 25, which are of a single stage type. The functional relationship between load pressure compensating means 20, which are used in control of both positive and negative loads and first valve means 17, including the direction control spool 23, are similar to those described in detail in my U.S. Pat. No. 4,222,409, issued Sept. 16, 1980. Briefly, first valve means 17 comprises the direction control spool 23, slidably guided in a bore 26 in a housing 27. The direction control spool 23 is provided with inflow variable metering orifice means, such as positive load or inflow metering slots 28 and 29 and outflow variable metering orifice means, such as negative load or outflow metering slots 30 and 31. One end of the direction control spool 23 projects into control space 32, subjected to pressure or control signal A, while the other end projects into control space 33, subjected to pressure of control signal B. In a well known manner the direction control spool 23 may be maintained in neutral position, as shown in FIG. 1, by centering spring 34, well known in the art. Bore 26 intersects first exhaust chamber 35, first load chamber 36, a supply chamber 37, second load chamber 38 and second exhaust chamber 39. One end of the direction control spool 23, protruding into control space 32 and subjected to the pressure of control signal A is subjected to a force equal to the product of the pressure of control signal A and cross-sectional area of the direction control spool 23. The other end of the direction control spool 23, protruding into control space 33 and subjected to pressure of the control signal B, is subjected to a force equal to the product of the pressure of control signal B and cross-sectional area of direction control spool 23. Control space 33, of first valve means 17, is connected by line 40 to a first control chamber 41 of the load pressure identifying means 18. In a similar manner control space 32 is connected by line 2 to a second control chamber 43. First load chamber 6 is connected by line 45 with a chamber 26, while second load chamber 38 is connected by line 47 with chamber 48. First and second control chambers 41 and 3 and chambers 46 and 48 are included in load pressure means 18, which is provided with load pressure identifying logic shuttle 44. Load pressure identifying means 18 can be of any type operable to identify load pressure signals, for example a check valve logic, shuttle valve logic, or electrical logic, which are all capable of identifying load pressure signals as positive or negative. Both the construction and operation of the load pressure identifying means 18, as shown in FIG. 1, were described in great detail in my U.S. Pat. No. 4,610,194, issued Sept. 9, 1986. Briefly, depending on whether the load W is positive or negative, in respect to the intended correction in its position, full displacement of the logic shuttle 44 in either direction, either connects positive load pressure to a port 49, or connects negative load pressure to ports 50 and 51.

The positive load pressure port 49 is connected by line 52 to space 53 of positive load compensating means 24, which is provided with a throttling spool 54. The throttling spool 54 is subjected to positive load pressure in space 53, pressure in space 55 and to the biasing force of a spring 56. The throttling spool 54 by the throttling action of throttling ports 57 controls the fluid flow from an inlet chamber 58 to an outlet chamber 29, which is connected by line 60 with the supply chamber 37 of the first valve means 17. When controlling a positive load, in a manner well known to those skilled in the art, the throttling spool 54, will automatically establish a modulating position, throttling by throttling port 57 the fluid flow from the inlet chamber 58 to the outlet chamber 59, to maintain a relatively constant pressure differential across an orifice created by displacement of the positive load metering slots 28 or 29.

The port 50 subjected to negative load pressure is connected by a line 61 to a control chamber 62 of a negative load compensating means 25, which is provided with a throttling spool 63. The throttling spool 63 is subjected to the negative load pressure in the control chamber 62, pressure in space 64 and to the biasing force of a spring 65. The throttling spool 63 by the throttling action of throttling port 66, controls the fluid flow from an outlet chamber 67 to an exhaust chamber 68, which is connected to the reservoir 14. When controlling a negative load, in a manner well known to those skilled in the art, the throttling spool 63 will automatically establish a modulating position, throttling by throttling port 66 the fluid flow from the outlet chamber 67 to the exhaust chamber 68, to maintain a relatively constant pressure differential across an orifice created by displacement of the negative load or outflow metering slots 30 or 31.

The port 51, subjected to negative load pressure, may be connected, as shown in FIG. 1, by line 69 to space 70 in communication with a free floating piston 71. During control of positive load with negative load pressure in space 70 at a very low level the free floating piston 71 is automatically maintained in the position as shown in FIG. 1, not affecting in any way whatsoever the control action of the throttling spool 54. During control of negative load, once the negative load pressure, acting on the cross-sectional area of the free floating piston 71, rises to a certain predetermined level, at which it will balance the preload of the spring 56, the free floating piston 71, together with the throttling spool 54 will move from right to left to a position in which the inlet chamber 58, connected by a line 72 to the pump 15, becomes isolated from the outlet chamber 59, which is connected by line 60 with the supply chamber 37. Therefore, during control of negative load, above a certain minimum negative load pressure level, as determined by the preload in the spring 56, with the use of the free floating piston 71 the condition of so-called negative load regeneration is achieved, which provides a synchronizing action between positive load compensating means 24 and negative load compensating means 25.

In the absence of the synchronizing feature of negative load regeneration, a free floating piston 73 can be used, which may be subjected to positive load pressure transmitted through line 74 to space 75 and to pressure in space 76, connected by line 77 to the reservoir 14. Therefore the free floating piston 73 is subjected to a force equal to the product of the positive load pressure in space 75 and its cross-sectional area. This force is transmitted through a free floating pin 78 to the throttling spool 63 and during control of positive load forcibly maintains the throttling spool 63 in fully open position, as shown in FIG. 1. During control of negative load, the positive load pressure signal in spaces 75 and 53 will be equivalent to the pressure at the inlet of the actuator 11. Under those conditions, through the action of the free floating piston 73, the throttling spool 63 is subjected to the force feedback related to the inlet pressure of the actuator 11, providing a synchronizing effect between the compensating action of the positive load compensating means 24 and negative load compensating means 25 and preventing development of excessive pressures in the actuator 11 through energy derived from the pump 15 during control of negative load.

With use of both free floating pistons 71 and 73, as shown in the embodiment of FIG. 1, during control of negative load the condition of negative load regeneration is achieved, automatically providing synchronization between positive load compensating means 24 and negative load compensating means 25 with the pump 15 isolated from the actuator 11 and inlet flow to the actuator 11 provided through the makeup valves 79 and 80 from the reservoir 14. During control of positive load the free floating piston 71 remains in position as shown in FIG. 1, while the free floating piston 73, subjected to positive load pressure transfers a force through the free floating pin 78, which maintains the throttling spool 63 in fully open position as shown.

The end of the direction control spool 23, which protrudes into control space 33, is maintained in contact with a shuttle 81, subjected to the biasing force of a spring 82. The shuttle 81 therefore moves with the displacement of the spool 23 and, in a manner well known to those skilled in the art, sequentially connects a chamber 83, subjected to Ps pressure, with the chamber 84 or 85, while also sequentially connecting those chambers to the pressure of the control signal B, existing in control space 33. Therefore, with the displacement of the direction control spool 23 and the shuttle 81 through a distance X in either direction, either chamber 84 or 85 will be connected to Ps pressure. Therefore with the displacement of the shuttle 81 through distance X in either direction, through the action of a shuttle 86, well known in the art, Ps pressure will be transmitted through line 87 to interconnecting means 22. With the shuttle 81 in neutral position, as shown in FIG. 1, through the action of a leakage orifice 88, the line 87 will be subjected to atmospheric pressure. The action of the shuttle 81, combined with the action of the shuttle 86, constitutes a signal generator and provides means responsive to position of spool 23, generally designated as 89.

Flow control means 21, in response to the command signals C1 and C2, generates A and B pressure signals, which are respectively transmitted to spaces 32 and 33 and, in a manner as described above, generate forces, which establish the displacement of the direction control spool 23, which in turn, due to the compensating action of the load pressure compensating means 20, establish, in a well known manner, the proportional fluid flow to and from the actuator 11. As is well known to those skilled in the art, the flow control means 21, for generation of A and B control pressure signals, can take many forms, the specific form being determined usually by whether the control signal C1 or C2 is electrical or hydraulic and by the degree of amplification of those command signals energywise to produce and A and B control pressure signals. In any event, the energy to amplify C1 and C2 command signals is usually supplied from a source of pressure which can be either an independent pump, or the system pump 15. Especially if the system pump 15 is used as a source of pressure, as shown n FIG. 1, it is customary to introduce a pressure reducing control 90 in order to prevent subjecting the flow control means 21 to excessive pressures.

The inlet chamber 58, connected by line 72 to the pump 15 in the embodiment of FIG. 1, is connected through line 91, a connecting means, such as a 3-way valve, generally designated as 92, and line 93 to the pressure reducing control 90. Under those conditions the flow control means 21 is provided with fluid power energy derived from the pump 15 and therefore the fluid power generated by the pump 15 is used in amplification of C1 and C2 signals to produce A and B pressure signals.

The 3-way valve 92, schematically shown in FIG. 1, is of a form well known in the art and is biased towards position as shown by a spring 94. In this position the segment of 3-way valve 92 by passage 95, connects lines 91 and 93, which in turn are connected by line 96 to a shuttle valve means, such as a shuttle 97, while the output of the shuttle 97 transmitted through line 98, is blocked by a stop 99. With the pressure in the line 87 exceeding a level as determined by the preload in the spring 94, in a well known manner, the 3-way valve 92, through the action of an actuating means, such as an actuator 100, will be shifted into a position in which passage 101 will connect the line 98 with the line 93, while the line 91 is effectively blocked by an isolating means, such as a stop 102. The shuttle 97 is connected by a line 103 and a line 104 with the first and second exhaust chambers 35 and 39.

Positive load pressure signals from the valve assembly 10 and another schematically shown system **106*a* are connected through the check valve logic system of check valves 107 and 108, well known in the art, in such a way that only the maximum positive load pressure of the loads being controlled is transmitted through line 109 to the output flow control 16 of the pump 15**.

First energizing means, generally designated as 105, is operable to interconnect the pump 15 with flow control means 21 and includes the 3-way valve 92 provided with passage 95 connecting lines 91 and 92.

Second energizing means, generally designated as 106, is operable to interconnect the first and second exhaust chambers 35 and 39, subjected to negative load pressure, to flow control means 21, permitting the use of negative load pressure for amplification of C1 or C2 command signals into A and B control pressure signals and includes 3-way valve 92 provided with passage 101, which connects, in response to the pressure in line 87, the line 98 with line 93.

Interconnecting means 22 includes 3-way valve 92, the shuttle 97, fluid conducting lines connecting the shuttle 97 with the source of negative load pressure and means 89 responsive to the position of the valve spool 23.

Figure 2:
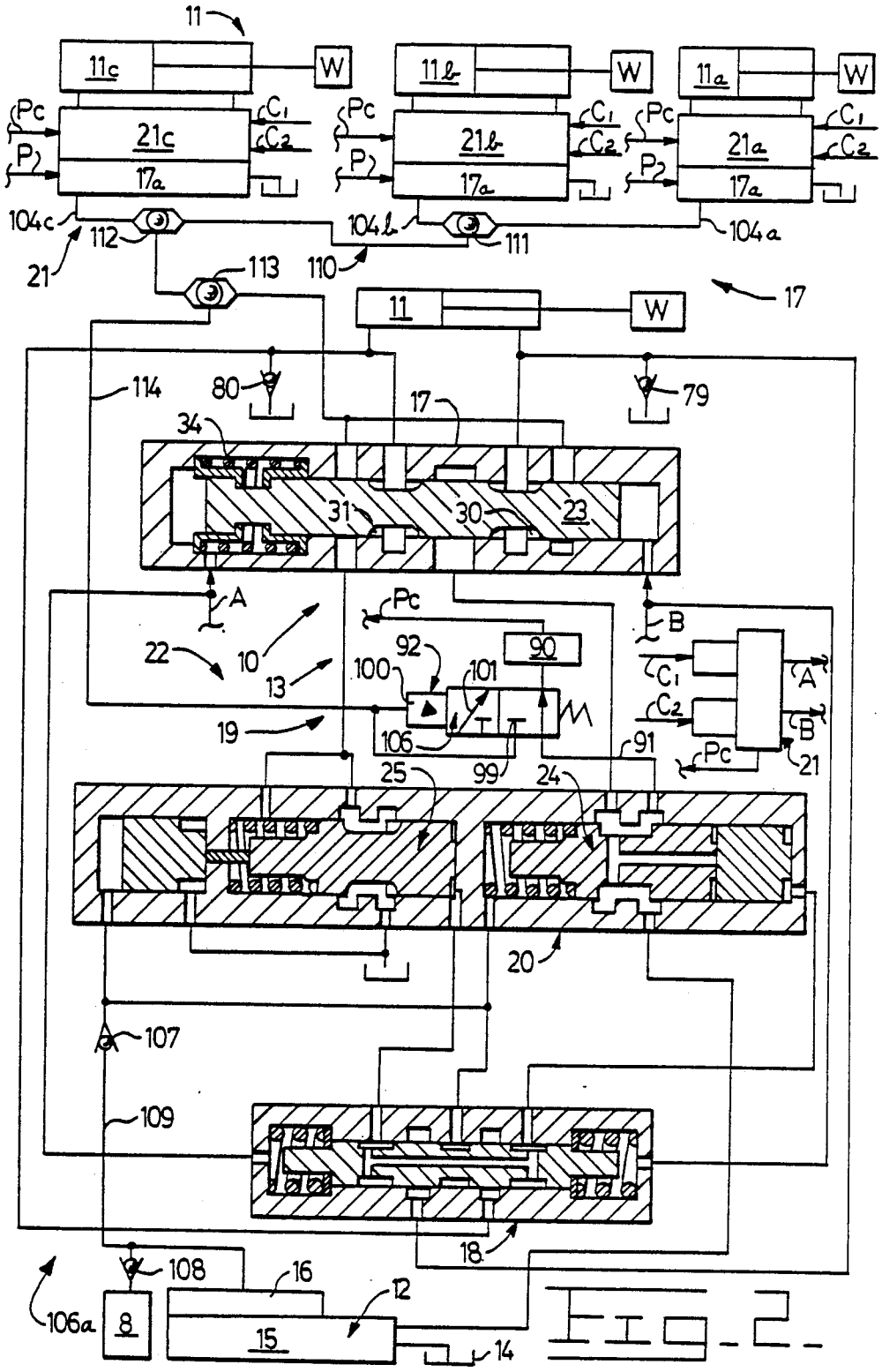
FIG. 2 shows a sectional view of a direction and flow control valve, throttling controls including positive and negative load compensators and an external logic module, with fluid motor, system pump, system reservoir, fluid power diverting valve, spool positioning controls, other fluid motors and corresponding control valves, and negative load pressure shuttle logic system shown diagrammatically, all connected into a working circuit by schematically shown fluid conducting lines.

Referring now to FIG. 2, like components of FIGS. 1 and 2 are designated by like numerals. All of the basic components of valve assembly 10 of FIG. 2, namely first valve means 17, load pressure compensating means 20, flow control means 21 and load pressure identifying means 18 are identical to those of FIG. 1, although first valve means 17 of FIG. 2 is not provided with means 89 responsive to position of spool 23. The main differences between the embodiment of FIGS. 1 and 2 are that in FIG. 2 the other system 106*a* is shown composed of multiple loads W connected to multiple actuators 11*a*, 11*b* and 11*c*, controlled respectively by schematically shown flow control means 21*a*, 21*b* and 21*c*, which in turn are operably connected to first valve means 17*a*, 17*b* and 17*c*, which in turn may be functionally interconnected to individual load pressure compensating means 20. The outlet chambers of first valve means 17*a*, 17*b* and 17*c* are connected by lines 104*a*, 104*b* and 104*c* with a negative load pressure shuttle logic system, generally designated as 10, which includes shuttle valves 111, 112 and 113, which, in a manner well known to those skilled in the art, will transmit the maximum negative load pressure signal of the negative loads being controlled to line 114, connected to the actuator 100 and the stop 99 of the 3-way valve 92.

Interconnecting means 22 of FIG. 2 includes 3-way valve 92, the negative load pressure shuttle logic 110, fluid conducting line 114 and line 91 connected to the system pump 15. Interconnecting means 22 supplies either positive or negative load pressure to the pressure reducing control 90, which supplies fluid power energy at Pc pressure to the flow control means 21*a*, 21*b* and 21*c*.

Referring now back to FIG. 1, the presence of pressure in line 87 develops a force in the actuator 100 of the 3-way valve 92, which is opposed by the biasing force of the spring 94. Once the force developed in the actuator 100 becomes greater than the biasing force of the spring 94, in a well known manner, the 3-way valve 92 is moved into a position, in which the system pump 15 becomes isolated from the pressure reducing control 90 by the stop 102 and the outlet of the actuator 11, subjected to the negative load, is simultaneously connected by passage 101 to the pressure reducing control 90 of flow control means 21. In this way the fluid power for control signal amplification is supplied to the flow control means 21 from the stored energy in the negative load. Any diversion of fluid power at negative load pressure during control of negative load would normally result in a change of position of such a negative load and therefore would adversely affect the stability, proportionality and transient response of the negative load control. However, in the embodiment of FIG. 1, the velocity of the negative load, due to the compensating action of negative load compensator means 25, is directly proportional to the flow area of the negative load, or outflow metering slots 30 or 31, caused by the displacement of the direction control spool 23. Since the fluid power at negative load pressure is supplied from downstream of the outflow metering slots 30 or 31, and from upstream of negative load compensating means 25, any diversion of fluid flow at negative load pressure will be automatically compensated through the amount of flow being throttled by the throttling port 66 of negative load compensating means 25. In this way the negative load energy can be diverted from the negative load control circuit, within the total amount of available energy, to perform other work, without affecting in any way whatsoever the quality of control of the negative load. In this way, since during control of negative load, the energy used by the negative load control is directly derived from the negative load and not from the system pump, not only the negative load energy, which during the negative load control must be converted into heat by throttling in the negative load controls, is used for a useful purpose, thus increasing the system efficiency, but also by not utilizing the fluid power from the pump circuit for negative load controls, the capability of the system pump to perform useful work is increased.

Once negative load compensating means 25 is used in control of a load, the presence of pressure in exhaust means 13, which includes first and second exhaust chambers 35 and 38, and which is positioned upstream of the throttling port 66, automatically signifies that the controlled load is of a negative type and that the system controls use the outflow from the actuator 11, in control of such a negative load. The shuttle 97 interconnects exhaust means 13 and the system pump 15 and, in a well known manner, only the higher pressure input of the two will be transmitted to line 98. Therefore if the pump pressure is higher than the negative load pressure, the line 98 will be subjected to pump pressure. If the negative load pressure is higher than the pump pressure, through the action of the shuttle 97, the line 98 will be subjected to negative load pressure. If the minimum pump pressure is so selected that it will meet the requirement of the flow control means 21, ensuring that no negative load pressure can be transmitted below this preselected level, the line 98 can be directly connected to the pressure reducing control 90, completely eliminating the need for the 3-way valve 92, or means 89 responsive to position of the spool 23. Under those conditions, through the use of the simple shuttle 97, the energy of the negative load can be used to supply fluid power to flow control means 21.

Under certain conditions, for maximum system efficiency, it is an advantage to completely unload the system pump 15, through the action of the output flow control 16, if the negative load pressure is high enough to supply the requirements of flow control means 21. The spring biased 3-way valve 92 ensures that the energy of the negative load can only be diverted to flow control means 21 above a certain minimum negative load pressure level. With this approach the output line 98 from the shuttle 97 can be connected to and supply the control signal to the actuator 100. In this way the preload of the spring 94 will dictate the pressure level, at which the fluid power from the negative load is connected to flow control means 21. With such an arrangement this negative load pressure level, in certain specific load responsive systems, can be made to unload the system pump 15, through its output flow control 16.

In the embodiment of FIG. 1, the presence of control pressure in line 87 leading to the 3-way valve 92 determines whether or not to divert the negative load energy to the flow control means 21. This is determined by the action of means 89, responsive to the position of spool 23. Within the range of displacement of the direction control spool 23 equal to X, irrespective of the magnitude of the negative load the energy to operate flow control means 21 is directly derived from the system pump, through the passage 95. Once the direction control spool 23 is displaced through a distance greater than X, in either direction, the Ps pressure signal is transmitted from means 89, through the shuttle 86 to the actuator 100. Ps pressure can be supplied in response to any specific parameter of the system, or can be the actual pressure of the negative load and therefore can be directly supplied from the port 50 or 51 of load pressure identifying means 18. If the Ps pressure is the negative load pressure then, in a manner as described above, the 3-way valve 92 will only connect the energy from the negative load to the flow control means 21, above a certain minimum negative load pressure level, as determined by the preload of the spring 94. The displacement of the direction control spool 23, within the distance X, signifies that the energy requirement of the flow control means 21 is small and therefore it might be preferable to use for control purposes the energy derived from the system pump. For large displacement of the direction control spool 23 large flows are required to displace it, requiring a higher use of energy. Under those conditions it is an advantage to use the energy of the negative load and conserve the energy from the pump.

The embodiment of FIG. 1 shows the synchronization of positive load compensating means 24 and negative load compensating means 25 using both negative load regeneration, through the action of the free floating piston 71 and through variation in the control pressure differential of the negative load compensating means 25, by the action of the free floating piston 73. The use of those two synchronizing methods results in the functional system, as described above. It should be noted however that the principal of variable pressure differential, using the free floating piston 73 to synchronize positive and negative load compensation, would normally be used in the control systems characterized by high frequency response, while the use of negative load regeneration, through the action of free floating piston 71, would be used in systems where system efficiency is of greater importance than the accuracy of the control.

Referring now back to FIG. 2, the control systems of FIGS. 1 and 2 are very similar and result in very similar control characteristics. The embodiment of FIG. 2 is of great advantage in a system in which a multiplicity of positive and negative loads are simultaneously controlled. The shuttle valve logic of FIG. 2 automatically supplies the energy from the negative load, at the negative load pressure to flow control means 21, ensuring that the source of negative load energy can only be connected to flow control means 21, above a certain predetermined negative load pressure level, as dictated by the characteristics of the flow control means 21. Since this energy, derived from the negative load, can be used simultaneously for operation of flow control means 21, 21*a*, 21*b* and 21*c*, irrespective of whether they control positive or negative load, great savings in energy can be achieved greatly increasing system efficiency, while also preserving the energy of the pump for control of positive loads.

The direction control spools 23 of FIGS. 1 and 2 are shown spring centered towards their neutral position by springs 34. As is well known to those skilled in the art, the direction control spools 23, in a well known manner, can be connected to spool position transducers, like for example LVDTs and the feedback signal from such transducers, together with the command signals C1 and C2, can be used in positioning of the direction control spools 23, using differential type amplifiers well known in the art.

The embodiments of FIGS. 1 and 2 show the use of fluid power, generated by a negative load on a selective basis, to provide the energy for use in flow control means 21. It should be noted that this selective use of the energy of the negative load, to supplement the energy derived from the system pump, especially in the embodiment of FIG. 2, can be used for other purposes than amplification of the control signals and can be used to operate other system components. Therefore, the fluid flow at Pc pressure can be used not only in amplification of the control signals, but to provide the energy to perform useful work in other components of the system. In this way the energy of negative loads, during control of such loads, can be used on a selective basis to supplement the energy derived from the system pump, not only increasing system efficiency, but also increasing the capacity of the system pump to perform useful work.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

I claim:

1. A load responsive control system comprising at least one actuator operable to control a positive and a negative load, exhaust means and a source of pressure fluid, first valve means operable to selectively interconnect said actuator with said exhaust means and said source of pressure fluid and to control fluid flow to and from said actuator, control means operable to provide energy to control the position of the first valve means to control fluid flow to and from said actuator, said control means having first energizing means operable to use energy from said source of pressure fluid to control the first valve means while said actuator controls a positive load, and second energizing means operable to use energy from said negative load to control the first valve means while said actuator controls a negative load.

2. A load response control system as set forth in claim 1 wherein said first valve means includes outflow variable metering orifice means interposed between said actuator and said exhaust means.

3. A load responsive control system as set forth in claim 2 wherein negative load pressure compensating means is interposed between said outflow variable metering orifice means and said exhaust means said negative load pressure compensating means operable to control pressure differential across said outflow variable metering orifice means.

4. A load responsive control system as set forth in claim 3 wherein interconnecting means selectively interconnects for fluid flow at negative load pressure upstream of said negative load pressure compensating means and said second energizing means.

5. A load responsive control system as set forth in claim 4 wherein said first valve means includes spool means provided with said outflow variable metering orifice means.

6. A load responsive control system as set forth in claim 4 wherein said interconnecting means includes shuttle valve means operably interconnecting said control means with outlet fluid flow from said actuator and with said source of pressure fluid.

7. A load responsive control system as set forth in claim 4 wherein said first valve means has spool means and said interconnecting means has means responsive to position of said spool means.

8. A load responsive control system as set forth in claim 4 wherein said interconnecting means has connecting means responsive to the pressure level of said negative load pressure and operable to permit fluid flow at negative load pressure to said second energizing means once said negative load pressure reaches a certain minimum predetermined level.

9. A load responsive control system as set forth in claim 8 wherein said interconnecting means includes isolating means responsive to said negative load pressure and operable to disconnect said first energizing means from said source of pressure fluid once said negative load pressure reaches a certain minimum predetermined level.

10. A load responsive control system as set forth in claim 1 wherein positive load compensating means is interposed between said first valve means and said source of pressure fluid.

11. A load responsive control system comprising a multiplicity of actuators operable to control positive and negative loads, exhaust means, and a source of pressure fluid, first valve means operable to selectively interconnect each of said fluid actuators with said exhaust means and said source of pressure fluid, outflow variable metering orifice means in said first valve means, negative load pressure compensating means downstream of each of said outflow variable metering orifice means, shuttle logic means operable to transmit maximum negative load pressure from downstream of said outflow variable metering orifice means, flow control means operably connected to each of said first valve means and operable to provide energy to control the position of each of the first valve means to control fluid flow to a from said actuators, said flow control means having first energizing means operable to use energy from said source of pressure fluid to control the first valve means when said actuators control positive loads, and second energizing means interconnected to said shuttle logic means and operable to use energy from said negative load to control the first valve means while any one of said actuators controls a negative load.

12. A load responsive control system as set forth in claim 11 wherein said first valve means has spool means and said second energizing means has actuating means responsive to position of said spool means.

13. A load responsive control system as set forth in claim 11 wherein said second energizing means has connecting means responsive to pressure level of said negative load pressure and operable to permit fluid flow at negative load pressure to said second energizing means once said negative load pressure reaches a certain minimum predetermined level.

14. A load responsive control system as set forth in claim 11 wherein said first energizing means includes isolating means responsive to said negative load pressure and operable to disconnect said source of pressure fluid from said flow control means once said negative load pressure reaches a certain minimum predetermined level.

15. A load responsive control system as set forth in claim 11 wherein positive load compensating means is interposed between each of said first valve means and said source of pressure fluid.

* * * * *